US009222332B2

(12) United States Patent
Hueston et al.

(10) Patent No.: US 9,222,332 B2
(45) Date of Patent: Dec. 29, 2015

(54) COILED TUBING PACKER SYSTEM

(71) Applicant: Halliburton Energy Services, Inc., Houston, TX (US)

(72) Inventors: Kenneth James Hueston, Edmonton (CA); Douglas Huber, Edmonton (CA)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 627 days.

(21) Appl. No.: 13/664,221

(22) Filed: Oct. 30, 2012

(65) Prior Publication Data

US 2014/0116684 A1 May 1, 2014

(51) Int. Cl.

| | |
|---|---|
| ***E21B 23/08*** | (2006.01) |
| ***E21B 23/06*** | (2006.01) |
| ***E21B 33/124*** | (2006.01) |
| ***E21B 33/128*** | (2006.01) |
| ***E21B 47/06*** | (2012.01) |

(52) U.S. Cl.

CPC ..... *E21B 33/124* (2013.01); *E21B 33/1285* (2013.01); *E21B 47/06* (2013.01)

(58) Field of Classification Search

CPC ... E21B 17/1007; E21B 17/20; E21B 17/206; E21B 19/08; E21B 23/06; E21B 23/08; E21B 33/128; E21B 47/12; E21B 19/22

USPC ..... 439/271

See application file for complete search history.

(56) References Cited

U.S. PATENT DOCUMENTS

| | | | | | |
|---|---|---|---|---|---|
| 4,324,407 | A | * | 4/1982 | Upham et al. | 277/336 |
| 4,619,323 | A | * | 10/1986 | Gidley | 166/285 |
| 5,411,081 | A | | 5/1995 | Moore et al. | |
| 5,488,992 | A | | 2/1996 | Pringle | |
| 5,544,706 | A | * | 8/1996 | Reed | 166/379 |
| RE36,525 | E | | 1/2000 | Pringle | |
| RE36,880 | E | | 9/2000 | Pringle | |
| 6,116,085 | A | * | 9/2000 | Moffatt et al. | 73/152.46 |

* cited by examiner

*Primary Examiner* — Cathleen Hutchins

(57) ABSTRACT

A wellbore monitoring system comprising a length of tubing defining an axial flowbore, two or more data conduits extending within the axial flowbore of the coiled tubing, two or more sensors, each of the two or more sensors configured to measure a wellbore parameter and to communicate data indicative of the measured wellbore parameter via one of the two or more data conduits, and two or more deployable tubular packers, each of the deployable tubular packers disposed within the axial flowbore of the tubing, wherein each of the deployable tubular packers is selectively secured within the axial flowbore of the tubing, and wherein the two deployable tubular packers provide fluid isolation between a first region of the axial flowbore, a second region of the axial flowbore, and a third region of the axial flowbore.

21 Claims, 6 Drawing Sheets

COILED TUBING PACKER SYSTEM

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Coiled tubing may be used in a variety of wellbore servicing operations including drilling operations, completion operations, stimulation operations, and other operations. Coiled tubing refers to relatively flexible, continuous tubing that can be run into the wellbore from a large spool which may be mounted on a truck or other support structure. While a rig must stop periodically to make up or break down connections when running drilling pipe or other jointed tubular strings into or out of the wellbore, coiled tubing can be run in for substantial lengths before stopping to join in another strand of coiled tubing, thereby saving considerable time by comparison to jointed pipe. The coiled tubing is typically run into and pulled out of the wellbore using a device referred to as an injector. As the injector feeds coiled tubing into the wellbore, coiled tubing is unrolled or "paid out" from the coiled tubing spool. As the injector withdraws coiled tubing out of the wellbore, coiled tubing is rolled onto or taken up by the coiled tubing spool.

Conventionally, sensors may be incorporated within the coiled tubing to communicate temperature, pressure, and/or other data to the surface via data conduits such as electrical wires. The electrical wires may interface with the operation of surface equipment which collect and store data measurements for various parameters (e.g., pressure, temperature) of the wellbore. For proper operation and reliable data measurements, the sensors need to be accurately and/or safely positioned within the bore of the coiled tubing. Conventional configurations of components (such as sensors) within coiled tubing strings may be insufficient to protect such components and may be difficult or cumbersome to deploy within the coiled tubing. As such, an improved means of positioning and/or securing sensors within a coiled tubing string is needed.

SUMMARY

Disclosed herein is a wellbore monitoring system comprising a length of tubing defining an axial flowbore, two or more data conduits extending within the axial flowbore of the coiled tubing, two or more sensors, each of the two or more sensors configured to measure a wellbore parameter and to communicate data indicative of the measured wellbore parameter via one of the two or more data conduits, and two or more deployable tubular packers, each of the deployable tubular packers disposed within the axial flowbore of the tubing, wherein each of the deployable tubular packers is selectively secured within the axial flowbore of the tubing, and wherein the two deployable tubular packers provide fluid isolation between a first region of the axial flowbore, a second region of the axial flowbore, and a third region of the axial flowbore.

Also disclosed herein is a wellbore monitoring method comprising assembling a wellbore monitoring system, wherein assembling the wellbore monitoring system comprises providing a length of tubing, wherein the tubing defines an axial flowbore, disposing two or more data conduits within the tubing, affixing a sensor to at least one of the two or more data conduits, securing two or more deployable tubular packers within the tubing, wherein securing the two or more deployable tubular packers within the tubing is effective to provide fluid isolation between a first region of the axial flowbore, a second region of the axial flowbore, and a third region of the axial flowbore, and establishing a port within the tubing, wherein the port provides a route of fluid communication from an exterior of the tubing to at least one of the two or more sensors.

Further disclosed herein is a wellbore monitoring method comprising providing a wellbore monitoring system comprising a length of tubing defining an axial flowbore, two or more sensors, and two or more deployable tubular packers, each of the deployable tubing packers disposed within the axial flowbore of the tubing so as to provide fluid isolation between a first region of the axial flowbore, a second region of the axial flowbore, and a third region of the axial flowbore, wherein a first sensor of the two or more sensors is located in the first region and a second sensor of the two or more sensors is located in a second region and a third region is a dry-coil region, disposing the wellbore monitoring system within a wellbore, and logging data from the two or more sensors.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
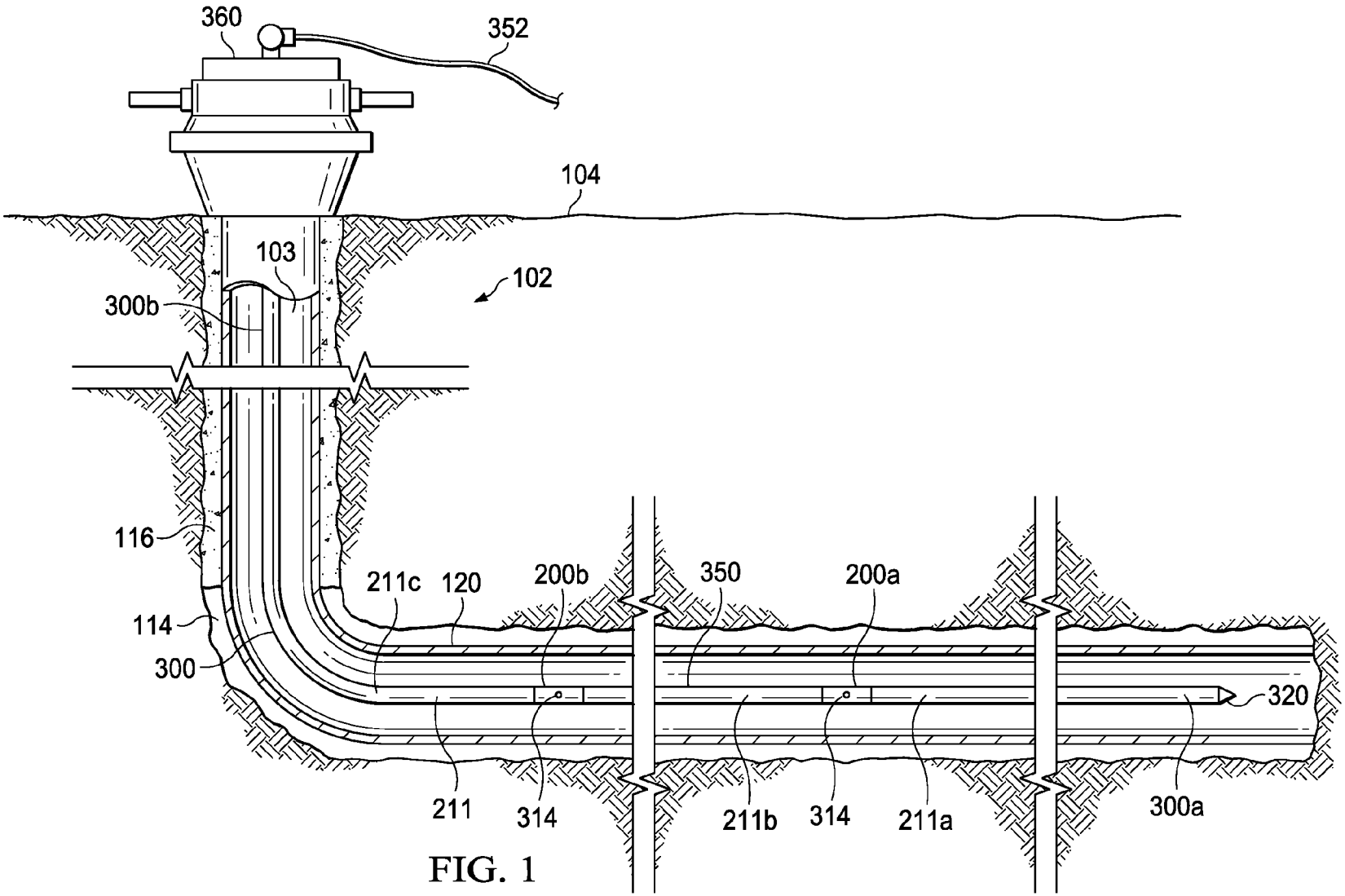
FIG. 1 is a partial cut-away view of an operating environment of a wellbore monitoring system depicting a wellbore penetrating a subterranean formation and a wellbore monitoring system comprising coiled tubing having a plurality of coiled tubing packers incorporated therein and positioned within the wellbore.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally from the formation toward the surface or toward the surface of a body of water; likewise, use of "down," "lower," "downward," "down-hole," "downstream," or other like terms shall be construed as generally into the formation away from the surface or away from the surface of a body of water, regardless of the wellbore orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

Disclosed herein, are embodiments of a coiled tubing packer assembly (CTPA), a wellbore monitoring system comprising coiled tubing having at least one CTPA disposed therein, and methods of using the same. In an embodiment as will be disclosed herein, a wellbore monitoring system comprises a CTPA, alternatively, two, three, or more CTPAs incorporated within a length of coiled tubing. In such embodiments, the CTPA may further comprise a plurality of wires connected to a plurality of sensors (e.g., pressure sensors, temperature sensors) which may be assembled within a coiled tubing string prior to insertion within a wellbore. Prior to introducing such a coiled tubing string into a wellbore, for example, for the purpose of monitoring one or more conduits within the wellbore, it may be desirable to assemble a coiled tubing to a given specification (e.g., having a quantity of sensors, types of sensors, sensor locations within the coiled tubing, length of coiled tubing, etc.). In such an embodiment, the CTPA may allow for assembly of the wellbore monitoring system without the use of inserts and/or without the need for segmenting the coiled tubing, and may enable a dry coil application of wellbore monitoring. For example, in such an embodiment, the plurality of wires, the plurality of sensors and/or other components may be positioned and secured within a single continuous segment or length of coiled tubing using one or more CTPAs, as will be disclosed herein. Additionally, in such an embodiment, the coiled tubing may only require access ports to expose the sensors to the wellbore and/or wellbore fluids. In such an embodiment, the plurality of wires may be isolated from the wellbore and/or wellbore fluids, thereby providing a dry coil application.

Referring to FIG. 1, an embodiment of an operating environment of a wellbore monitoring system 350 is illustrated. In the embodiment of FIG. 1, the wellbore monitoring system 350 comprises a length of coiled tubing 300 and two CTPAs 200 positioned within a wellbore 114.

In an embodiment, the wellbore 114 may extend substantially vertically away from the earth's surface 104 over a vertical wellbore portion, or may deviate at any angle from the earth's surface 104 over a deviated or horizontal wellbore portion. In alternative operating environments, portions or substantially all of the wellbore 114 may be vertical, deviated, horizontal, and/or curved. It is noted that although some of the figures may exemplify horizontal or vertical wellbores, the principles of the methods, apparatuses, and systems disclosed herein may be similarly applicable to horizontal wellbore configurations, conventional vertical wellbore configurations, and combinations thereof. Therefore, the horizontal or vertical nature of a wellbore illustrated in any figure is not to be construed as limiting the wellbore to any particular configuration.

In the embodiment of FIG. 1, the wellbore 114 is lined with a casing string 120 or liner. In such an embodiment, the casing string 120 may be at least partially secured into position against the formation 102 by conventional means (e.g., using cement 116) or alternatively, using packers (e.g., mechanical packers, swellable packers, etc.). In an alternative embodiment, the wellbore 114 may be partially cased and cemented thereby resulting in a portion of the wellbore 114 being uncased and/or uncemented (e.g., an "open-hole"). In an embodiment, the casing string 120 may be sealed at the earth's surface 104, for example, via a casing string cover 360.

In an embodiment, the wellbore monitoring system 350 is disposed within the casing string 120 (e.g., within an axial flowbore of the casing string 120), the casing string 120 having previously been positioned within the wellbore 114 penetrating the subterranean formation 102, as illustrated in FIG. 1. In an embodiment, the wellbore monitoring system 350 may be delivered to a predetermined depth within the wellbore 114, for example, via a coiled tubing unit located at the earth's surface 104. In an embodiment, the wellbore monitoring system 350 may interface with and/or be secured to (e.g., suspended from) the casing string cover 360 mounted at the earth's surface 104. For example, the wellbore monitoring system 350 may be run into the wellbore using a mobile coiled tubing unit, disconnected from the mobile unit, and connected to one or more wellhead support structures (e.g., casing string cover 360) to allow the wellbore monitoring system 350 to remain in the wellbore for a desired monitoring period (e.g., long term wellbore monitoring). In an embodiment, at least a portion of the wellbore monitoring system 350 may pass through the casing string cover 360 and may provide access to a plurality of wires or other data conduits 352 from the wellbore monitoring system 350 as will be disclosed herein.

In an embodiment, the wellbore monitoring system 350 may generally comprise a length of coiled tubing (e.g., coiled tubing string 300), at least two CTPAs 200 (e.g., a first CTPA 200*a* and a second CTPA 200*b*), a plurality of sensors 310, and a plurality of data conduits 312, as will be disclosed herein.

In an embodiment as illustrated in FIG. 1, the coiled tubing 300 may generally comprise a length of tubing, for example, a continuous steel tubing string of a desired length. For example, the coiled tubing may range in length from about 2,000 ft. to about 15,000 ft. Also, the coiled tubing may have an outside diameter of from about 1 inch to about 4½ inches, for example, a diameter of about 1¼ inches. In an embodiment, the coiled tubing 300 is generally a cylindrical or tubular-like structure. In an embodiment, the coiled tubing 300 may generally define an axial flowbore 211. In an embodiment, the coiled tubing 300 may be formed of any suitable material as would be appreciated by one of skill in the art (e.g., steel, aluminum, plastic, copper, etc.). In an embodiment, the coiled tubing 300 may be spoolable and/or unspoolable (e.g., able to be spooled and unspooled). For example, the coiled tubing 300 may be initially wound onto a spool, and then unwound, and straightened prior to being positioned within the wellbore 114 (e.g., via the operation of a coiled tubing unit).

In an embodiment, the coiled tubing 300 may comprise a plurality of sensor ports 314. In an embodiment, the plurality of sensor ports 314 may provide a route of fluid communication from the axial flowbore 211 of the coiled tubing 300 to the exterior of the coiled tubing 300. For example, in such an embodiment the sensor ports 314 may allow fluid communication between the environment exterior to the coiled tubing 300 (or a portion thereof) and one or more of the sensors 310 positioned therein (e.g., such that the sensor or sensors may experience one or more wellbore conditions, such as a temperature or pressure). In an embodiment, the plurality of sensor ports 314 may be introduced into the coiled tubing 300 as part of a wellbore monitoring system assembly method, for example, by drilling into the coiled tubing 300 using a drilling jig, as will be disclosed herein.

In an embodiment, the coiled tubing 300 may be sealed on one or both ends, for example, with a terminal cap 320 at the downhole terminal end of the coiled tubing 300. In an embodiment, the terminal cap 320 may comprise a suitable connection to the coiled tubing 300, for example, connected to the coiled tubing 300 via internally or externally threaded surfaces. In another embodiment, the terminal cap 320 may comprise a welded connection to the coiled tubing 300. Additionally or alternatively, suitable connections to the coiled tubing string as will be known to those of skill in the art. In an embodiment, the terminal cap 320 may comprise a "bull plug" or "bull nose plug"; alternatively, the terminal cap 320 may comprise any suitable type and/or configuration or plug or cap as will be appreciated by a person of skill in the arts upon viewing this disclosure.

In an embodiment, each of the two or more CTPAs 200 may be generally configured to selectively engage an inner bore of a coiled tubing (e.g., the coiled tubing 300) and may provide isolation (e.g., fluid isolation) of various regions of the axial flowbore 211 of the coiled tubing 300. For example, in the embodiment of FIG. 1, where two CTPAs 200 are present, the CTPAs 200 are deployed within the coiled tubing 300 so as to fluidicly isolate a first coiled tubing region 211*a* (e.g., a lower-most portion), a second coiled tubing region 211*b* (e.g., an intermediary region), and a third coiled tubing region 211*c* (e.g., an upper-most region).

Figure 2:
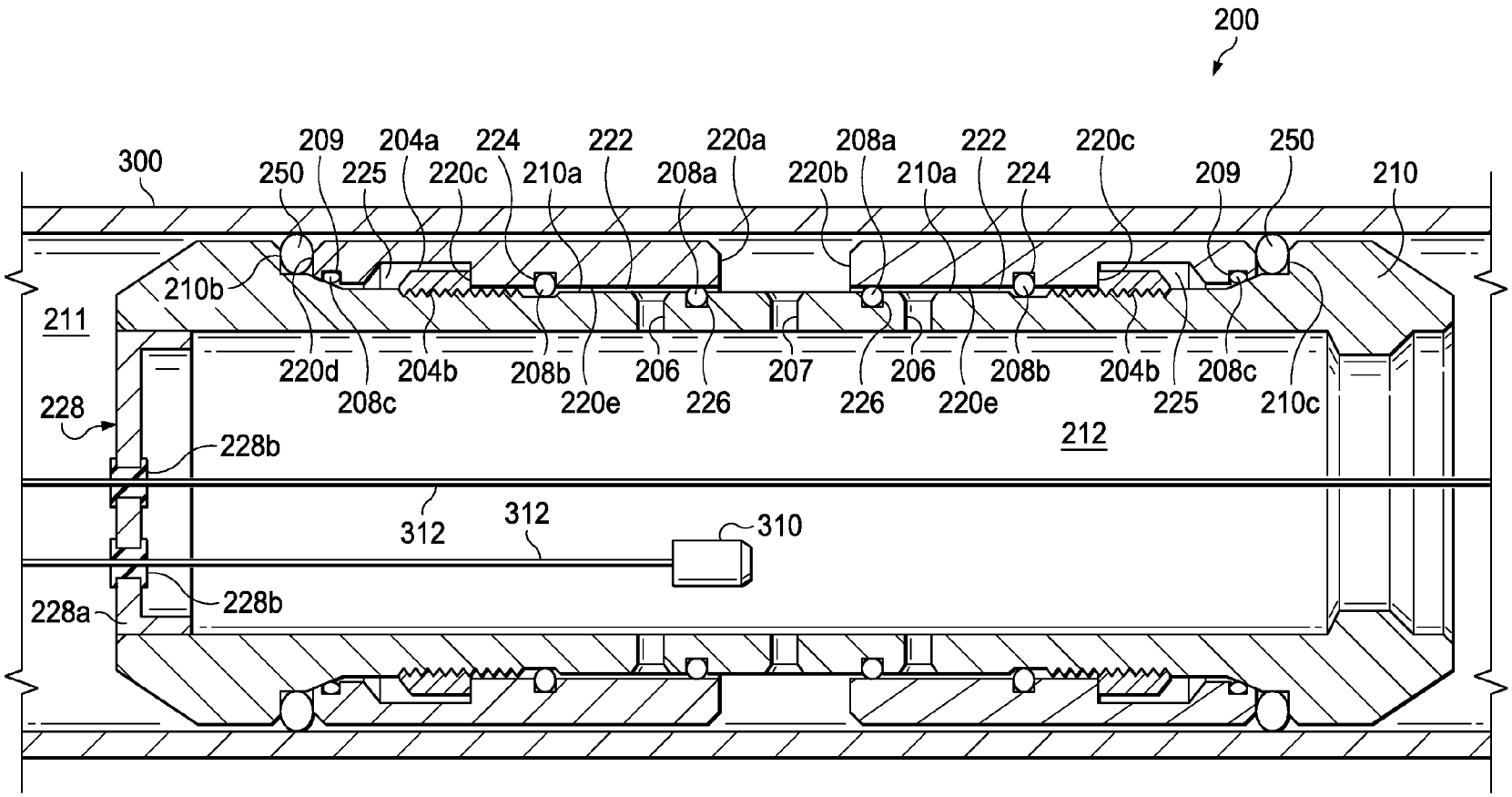
FIG. 2 is a close-up, partial cut-away view of an embodiment of a portion of a coiled tubing packer of the wellbore monitoring system.

Referring to FIG. 2, in an embodiment, each of the two or more CTPA 200 may comprise a housing 210, a plurality of sealing mechanisms 250, a plurality of ports 206, a plurality of pressure cavities 222, a first sliding sleeve 220*a*, a second sliding sleeve 220*b*, and a locking system 204.

In an embodiment, the housing 210 of the CTPA 200 is a generally cylindrical or tubular-like structure (e.g., a mandrel). The housing 210 may be unitary in structure; alternatively, the housing 210 may be made up of two or more operably connected components (e.g., an upper component, and a lower component). Alternatively, a housing 210 may comprise any suitable structure; such suitable structures will be appreciated by one of skill in the art with the aid of this disclosure.

In an embodiment, the housing 210 generally defines an axial flowbore 212. In an embodiment, the housing 210 may be described as having an outer diameter smaller than an interior bore diameter of the coiled tubing 300, for example, such that the CTPA 200 may be positioned within the coiled tubing 300. In an embodiment, the housing 210 comprises a plurality of fixed contact surfaces 210*b* oriented generally perpendicularly to the axial flowbore 212 flow path. In an embodiment, the plurality of fixed contact surfaces 210*b* may be described as having a diameter greater than the axial flowbore 212 of the housing.

In an embodiment, the housing 210 comprises a plurality of ports 206. In an embodiment, the ports 206 may extend radially outward from and/or inward towards the axial flowbore 212. As such, these ports 206 may provide a route of fluid communication from the axial flowbore 212 to an exterior of the housing 210. For example, the CTPA 200 may be configured such that the ports 206 provide a route of fluid communication between the axial flowbore 212 and a plurality of pressure cavities 222, as will be disclosed herein.

In an embodiment, the CTPA 200 may further comprise one or more sensor ports 207. In an embodiment, the sensor ports 207 may extend radially outward from and/or inward towards the axial flowbore 212. As such, these sensor ports 207 may provide a route of fluid communication from the axial flowbore 212 to an exterior of the housing 210. For example, the CTPA 200 may be configured such that the sensor port 207 provides a route of fluid communication between the axial flowbore 212 and the one or more sensor ports 314 of the coiled tubing 300, as will be disclosed herein.

In an embodiment, the CTPA 200 may comprise one or more sealing elements 250 generally configured to selectively engage the housing 200 within the coiled tubing 300 (e.g., within the axial flowbore 211 of the coiled tubing 300), as will be disclosed herein. The sealing elements 250 may be constructed of, for example, a flexible or substantially flexible material (e.g., an elastomeric material), a swellable material (e.g., an expanding elastomeric material), and/or some combination thereof. In such an embodiment, the one or more sealing elements 250 may include, but are not limited to, a T-seal, an O-ring, a gasket, and/or suitable components, as would be appreciated by one of skill in the art upon viewing this disclosure.

In an embodiment, the sealing elements 250 may slidably and concentrically disposed about/around at least a portion of the housing 210, as will be disclosed herein. For example, in an embodiment, the sealing member 250 (or a portion thereof) may slide or otherwise move (e.g., axially or radially) with respect to the housing 210, for example, upon the application of a force to the sealing elements 250. In an embodiment, the sealing elements 250 may be generally configured to expand radially outward when compressed laterally/longitudinally, as will also be disclosed herein.

Referring to FIG. 2, the first sliding sleeve 220*a* and the second sliding sleeve 220*b* each generally comprise a cylindrical or tubular structure comprising an axial flowbore extending there-through. In an embodiment, the first sliding sleeve 220*a* and/or the second sliding sleeve 220*b* may each comprise one or more segments (e.g., an upper segment and a lower segment) which may be coupled together by any suitable methods as would be appreciated by one of skill in the art, for example, internal or external threads. In an alternative embodiment, the first sliding sleeve 220*a* and/or the second sliding sleeve 220*b* may each comprise a unitary structure (e.g., a single solid piece).

Figure 3A:
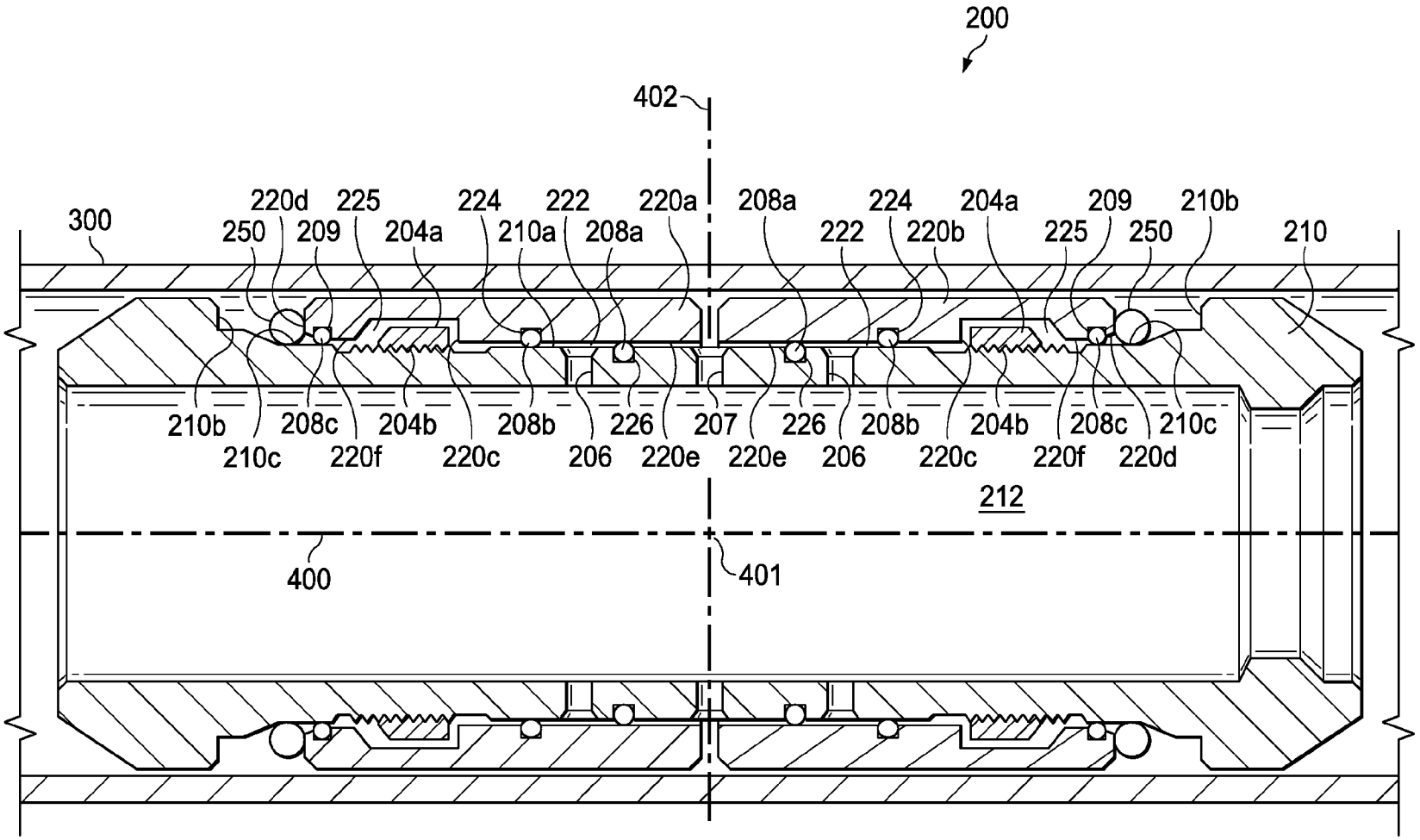
FIG. 3A is a cut-away view of an embodiment of a flexible coiled tubing packer in a first configuration.
Figure 3B:
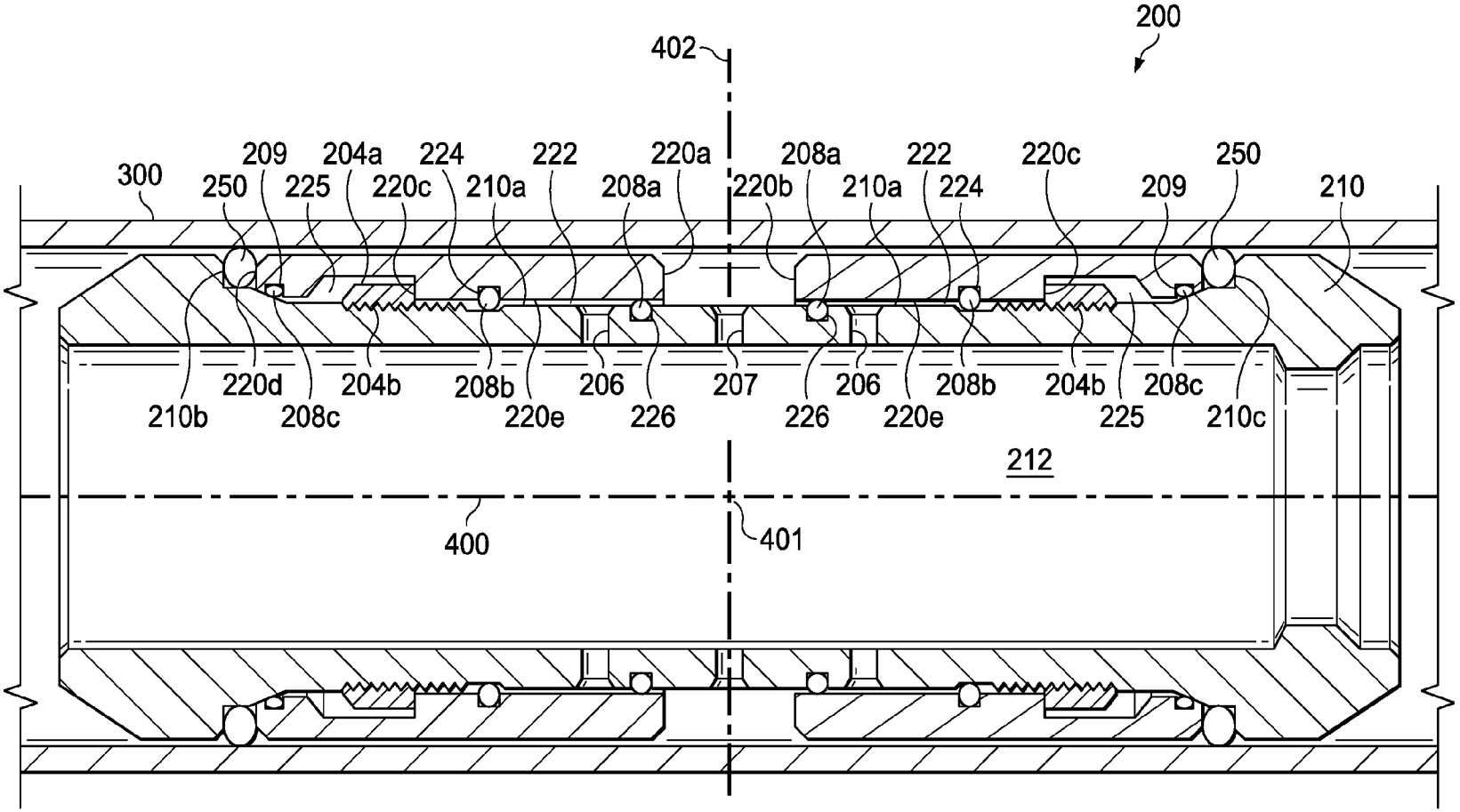
FIG. 3B is a cut-away of an embodiment of a flexible coiled tubing packer in a second configuration.

In an embodiment, the first sliding sleeve 220*a* and the second sliding sleeve 220*b* may each comprise one or more shoulders or the like, generally defining one or more cylindrical surfaces of various diameters. Referring to FIG. 3A and FIG. 3B, the first sliding sleeve 220*a* and the second sliding sleeve 220*b* each comprise a first contact surface 220*c* (e.g., a shoulder), a second contact surface 220*d* (e.g., a shoulder), and a sliding sleeve cylindrical cavity surface 220*e*.

In an embodiment, the first sliding sleeve 220*a* and the second sliding sleeve 220*b* are each slidably disposed about/around an exterior surface of the housing 210. In such an embodiment, at least a portion of the interface between the first sliding sleeve 220*a* and the housing 210 and/or at least a portion of the interface between the second sliding sleeve 220*b* and the housing 210 may be fluid-tight and/or substantially fluid-tight. For example, in the embodiment of FIGS. 2, 3A, and 3B, the CTPA 200 comprises a stationary seal 208*a* and a first sliding seal 208*b* at the interface between a first sliding sleeve cylindrical cavity surface 220*e* (e.g., of each of the first sliding sleeve 220*a* and the second sliding sleeve 220*b*) and a first cylindrical housing cavity surface 210*a* of the housing 210. Additionally, the CTPA 200 may further comprise a second sliding seal 208*c* at an interface between a second sliding sleeve cylindrical cavity surface 220*f* (e.g., of each of the first sliding sleeve 220*a* and the second sliding sleeve 220*b*) and the second contact surface 220*d*. For example, in such an embodiment, one or more seals (e.g., the stationary seal 208*a*, the first sliding seal 208*b*, and/or the second sliding seal 208*c*) may prohibit or restrict fluid movement via each of these interfaces.

In such an embodiment, the seals (e.g., the stationary seal 208*a*, the first sliding seal 208*b*, and/or the second sliding seal 208*c*) may each be generally disposed within a groove or recess within the first sliding sleeve 220*a*, the second sliding sleeve 220*b*, or the housing 210. For example, in the embodiment of FIGS. 2, 3A, and 3B, the first sliding seal 208*b* may be disposed within the first sliding seal groove or chamber 224 and the second sliding seal 208*c* may be disposed within a sliding seal groove or chamber 209 within the first and second sliding sleeves 220*a* and 220*b*. Additionally, in the embodiment of FIGS. 2, 3A, and 3B, the stationary seal 208*a* may be disposed about/around the housing 210 within a stationary seal groove or chamber 226. In an embodiment the stationary seal 208*a* may be disposed in a fixed position relative to the housing 210 within a stationary seal chamber 226 within the exterior surface of the housing 210. In an embodiment, the one or more seals (e.g., the stationary seal 208*a*, the first sliding seal 208*b*, and/or the second sliding seal 208*c*) may include, but are not limited, to a T-seal, an O-ring, a gasket, and/or suitable components, as would be appreciated by one of skill in the art upon viewing this disclosure.

In an embodiment, the interface between the housing 210 and the first sliding sleeve 220*a* or the second sliding sleeve 220*b* comprises a plurality of pressure cavities 222. In an embodiment, each of the pressure cavities 222 is generally defined by the stationary seal 208*a*, the first sliding seal 208*b*, at least a portion of the sliding sleeve cylindrical cavity surface 220*e* spanning between the stationary seal 208*a* and the first sliding seal 208*b*, and at least a portion of the cylindrical housing cavity surface 210*a* spanning between the stationary seal 208*a* and the first sliding seal 208*b*, as illustrated in FIGS. 2, 3A, and 3B.

In an embodiment, the first sliding sleeve 220*a* and the second sliding sleeve 220*b* may each be movable from a first position to a second position with respect to the housing 210, as will be disclosed herein. In an embodiment, the first sliding sleeve 220*a* and the second sliding sleeve 220*b* may each be positioned such that the sealing elements 250 either engage or, alternatively, do not engage the interior of the coiled tubing 300, dependent upon the position of the first sliding sleeve 220*a* and the second sliding sleeve 220*b* relative to the housing 210.

In the embodiment of FIG. 3A, the first sliding sleeve 220*a* and the second sliding sleeve 220*b* are each illustrated in the first position. In the first position the first sliding sleeve 220*a* and the second sliding sleeve 220*b* may each be in direct or indirect contact with the sealing element 250 and/or may not apply a significant force onto the sealing element 250. For example, in such an embodiment, the sealing elements 250 are relatively uncompressed (e.g., laterally) and, as such, are relatively unexpanded (e.g., radially). In such an embodiment, the sealing element 250 may not engage the interior of the coiled tubing 300.

In the embodiment of FIG. 3B, the first sliding sleeve 220*a* and the second sliding sleeve 220*b* are each illustrated in the second position, for example, in which the first sliding sleeve 220*a* and the second sliding sleeve 220*b* may each be extended away from each other and in the direction of the fixed contact surface 210*b*. In an embodiment, the second contact surface 220*d* of the first sliding sleeve 220*a* and the second sliding sleeve 220*b* may engage the sealing element 250 with an applied force onto the sealing element 250 and against the fixed contact surface 210*b* of the housing 210. In such an embodiment, the sealing elements 250 are relatively more compressed (e.g., laterally) and, as such, relatively more radially expanded (in comparison to the sealing elements when the first sliding sleeve 220*a* and the second sliding sleeve 220*b* are in the first position) and may prevent fluid communication in an annular space between coil tubing 300 and the exterior of the housing 210. In such an embodiment, the sealing element 250 may engage the coiled tubing 300. Additionally, in an embodiment, the first sliding sleeve 220*a* and the second sliding sleeve 220*b* may be restricted and/or prohibited from returning to the first position by the locking system 204, as will be disclosed herein.

In an embodiment, the first sliding sleeve 220*a* and the second sliding sleeve 220*b* may be configured to be selectively transitioned from the first position to the second position. For example, in an embodiment the first sliding sleeve 220*a* and the second sliding sleeve 220*b* may be configured to transition from the first position to the second position upon the application of a fluid pressure (e.g., air pressure of at least a first threshold) to the axial flowbore 212 of the housing 210. In such an embodiment, the first sliding sleeve 220*a* and the second sliding sleeve 220*b* may comprise a differential in the surface area of the medial-facing surfaces which are fluidly exposed to the axial flowbore 212 of the housing 210 and the peripheral-facing surfaces which are fluidly exposed to the axial flowbore 212 of the housing 210. For example, in the embodiments of FIG. 3A and FIG. 3B, the surface area of the surfaces of the first sliding sleeve 220*a* and the second sliding sleeve 220*b* which will apply a force (e.g., a force resultant from the application of air pressure to the axial flowbore 212) in the direction towards the second position (e.g., an outward force, relative to a center point 401 of the housing 210) may be greater than the surface area of the surface areas of the first sliding sleeve 220*a* and the second sliding sleeve 220*b* which will apply a force (e.g., a force resultant from the application of air pressure to the axial flowbore 212) in the direction away from the second position. For example, in the embodiment of FIG. 3A and FIG. 3B, and not intending to be bound by theory, the interfaces at the first sliding seal 208*b* and the second sliding seal 208*c*, as disclosed above, are fluidly sealed (e.g., by one or more O-rings), resulting in a chamber 225 which is unexposed to air pressures applied to the axial flowbore 212. In such an embodiment, the second sliding sleeve cylindrical cavity surface 220*f* may be characterized as having a diameter greater than the diameter of the first sliding sleeve cylindrical cavity surface 220*e* with reference to central longitudinal axis 400. Similarly, the second cylindrical housing cavity surface 210*c* may be characterized as having a diameter greater than the diameter of the first cylindrical housing cavity surface 210*a* with reference to central longitudinal axis 400. As such, the application of pressure to the axial flowbore 212 may result in a differential in the forces applied to the first and second sliding sleeves 220*a* and 220*b* in the direction toward the second position (e.g., an outward force) and the forces applied to the first and second sliding sleeves 220*a* and 220*b* in the direction away from the second position (e.g., and inward force). Particularly, the application of pressure to the axial flowbore 212 may result in a net force applied to both the first and second sliding sleeves 220*a* and 220*b* in the direction toward the second position.

In an embodiment, the first sliding sleeve 220*a* and the second sliding sleeve 220*b* may each be configured to be retained in the second position by a locking system 204 (e.g., a snap ring, a C-ring, a biased pin, ratchet teeth, or combination thereof). For example, in the embodiment of FIGS. 2, 3A, and 3B, the locking system 204 may comprise a sliding lock 204*a* and locking teeth 204*b*. In such an embodiment, the sliding lock 204*a* may comprise ratcheting teeth (or the like) and may be positioned in a suitable slot, groove, channel, bore, or recess, in the first sliding sleeve 220*a* and the second sliding sleeve 220*b*, alternatively, in the housing 210, and may be expand into and be received by a suitable groove, channel, bore, or recess in the housing 210, or alternatively, the first sliding sleeve 220*a* and the second sliding sleeve 220*b*. For example, in the embodiment of FIG. 3A and FIG. 3B, the sliding lock 204*a* may be carried within a groove or channel within the first sliding sleeve 220*a* and/or the second sliding sleeve 220*b* and may be advanced outward across the locking teeth 204*b* present on an outer surface of the housing 210.

In an embodiment as shown in FIGS. 2 and 4, the wellbore monitoring system 350 may comprise a plurality of sensors 310 (e.g., a first sensor 310*a* and a second sensor 310*b*) and a plurality of data conduits 312. In an embodiment, the sensors 310 may comprise one or more temperature sensors, pressure sensors, barometers, acoustic sensors, optical sensors, magnetic sensors, vibration sensors, pH sensor, thermocouple sensors, chemical sensors, or any suitable sensor or combinations thereof as would be appreciated by one of skill in the art. For example, the sensors 310 can be any type of sensor suitable for determining a wellbore condition (e.g., a downhole condition) of interest.

In an embodiment, the data conduits 312 may comprise one or more electrical wires, copper wires, insulated solid core wires, insulated stranded wires, unshielded twisted pairs, optical fibers, fiber optic cables, coaxial cables, or any other suitable wires or combinations thereof, as would be appreciated by one of skill in the art upon viewing this disclosure. For example, in an embodiment, the plurality of data conduits 312 may comprise one or more of a first insulated copper wire, a second copper wire, and a fiber optic cable; alternatively, any suitable combinations or configurations of data conduits 312 may be employed as would be appreciated by one of skill in the art upon viewing this disclosure. In an embodiment, the sensors 310 may be individually connected to one or more of the data conduits 312 by any suitable means (e.g., by any suitable connection) as would be appreciated by one of skill in the art (e.g., hard-wired electrical connections or mating connecters).

In an embodiment, the plurality of sensors 310 may be disposed within the axial flowbore 211 of the coiled tubing 300. Additionally or alternatively, in an embodiment, the each of the plurality of sensors 310 may be disposed proximate to and/or within axial flowbore 212 of the housing 210 of one of the first CTPA 200*a* of the second CTPA 200*b*. In an embodiment, one or more sensors 310 may be positioned proximate to and/or in communication with the sensor port 314 of the coiled tubing 300 and/or the sensor port 207 of the CTPAs 200*a* and 200*b*.

Figure 5:
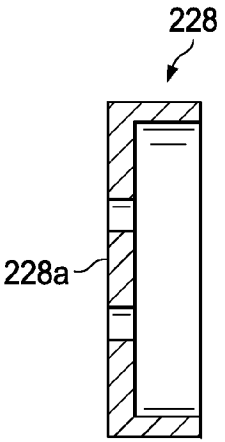
FIG. 5 is a cut-away view of an embodiment of a fluid barrier for inclusion within the wellbore monitoring system.

In an embodiment, the wellbore monitoring system 350 may be configured such that the various sensors (e.g., the first sensor 310*a* and the second sensor 310*b*) may be at least substantially fluidicly isolated and/or such that at least a portion of the data conduits 312 are substantially isolated from fluid (e.g., a "dry coil"). For example, in an embodiment, each of the first and second CTPAs, 200*a* and 200*b*, comprises a fluid barrier 228 (e.g., the fluid barrier 228 as illustrated in FIG. 5). Referring to FIG. 2, in an embodiment the fluid barrier 228 may be positioned (e.g., secured, via a suitable connection) within or at least partially within the axial flowbore 212 of the CTPAs. The fluid barrier 228 may generally comprise a restrictor 228*a* and one or more grommet-systems 228*b* (e.g., a Conax-Buffalo System). In an embodiment, the restrictor 228*a* may comprise a disc or plate correspondingly sized and/or otherwise configured for placement or mating within the CTPA 200 and comprising one or more bores, for example, allowing for a data conduit 312 to be passed therethrough. In an embodiment, the grommet-systems 228*b* may be disposed onto the one or more data conduits 312 and within the bores within the restrictor 228*a*. In an embodiment, the grommet-systems 228*b* may fit tightly around the one or more data conduits 312, thereby forming a fluid-tight or substantially fluid-tight barrier within the bores of restrictor 228, which in turn seals axial flowbore 212 of the housing 210, which in turn seals (e.g., via compressed sealing elements 250) the axial flowbore 211 of the coiled tubing 300, for example, fluidicly isolating at least three regions of the axial flow bore (e.g., a first coiled tubing region 211*a*, a second coiled tubing region 211*b*, and a third coiled tubing region 211*c*). For example, in an embodiment, the fluid barrier 228 (e.g., in combination with the sealing elements 250) may restrict or prohibit a route of fluid communication within the axial flow bore 211 of the coiled tubing 300. In an embodiment, the fluid barriers 228 may each be positioned on the "uphole" opening of the CTPA 200 and may be disposed onto the housing 210 and/or at least partially within the axial bore 212 of the housing 210 of the CTPA 200. In such an embodiment, the grommets 228 may be joined with the fluid barriers 228 using any suitable methods as would be appreciated by one of skill in the art upon viewing this disclosure.

In an embodiment, the first coiled region 211*a* may be generally defined by a region of the coiled tubing 300 spanning between the fluid barrier 228 of the first CTPA 200*a* and the toe end 300*a* of the coiled tubing 300, the second coiled region 211*b* may be generally defined by a region of the coiled tubing 300 spanning between the fluid barrier 228 of the second CTPA 200*b* and the fluid barrier 228 of the first CTPA 200*a*, and the third coiled region 211*c* may be generally defined by a region of the coiled tubing 300 spanning between the heel end 300*b* of the coiled tubing 300 and the fluid barrier 228 of the second CTPA 200*b*. In an embodiment, the third coiled region 211*c* may be substantially dry (e.g., the two or more data conduits 312 are not immersed in a wellbore fluid) and may be filled with an inert fluid (e.g., nitrogen gas, etc.)

Figure 4A:
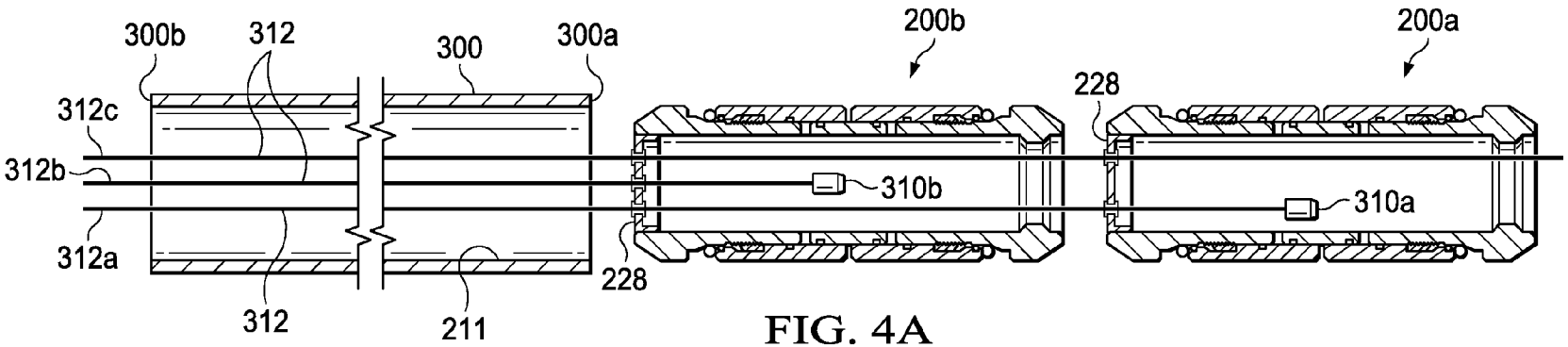
FIG. 4A is a cut-away view of an embodiment of a wellbore monitoring system during a first stage of assembly.
Figure 4B:
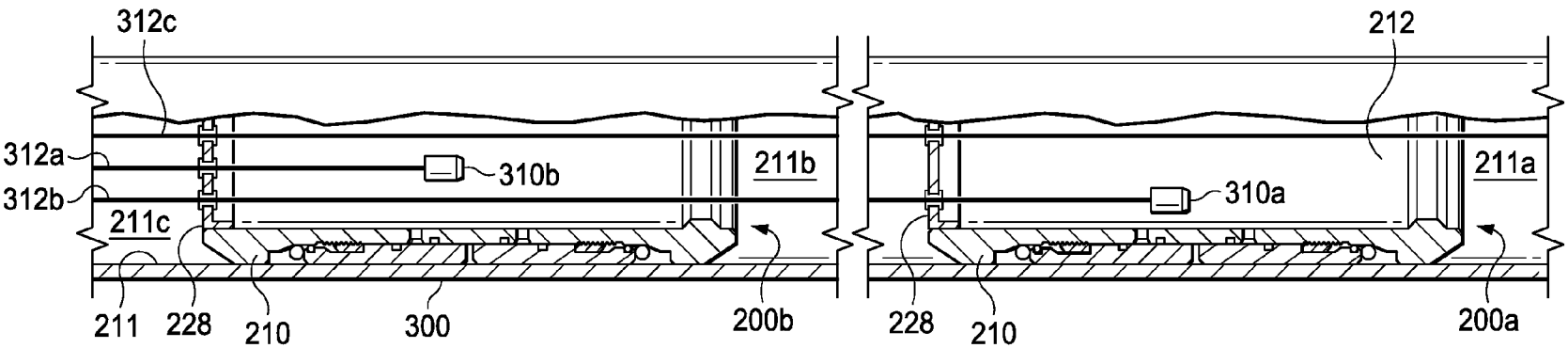
FIG. 4B is a cut-away view of an embodiment of a wellbore monitoring system during a second stage of assembly.
Figure 4C:
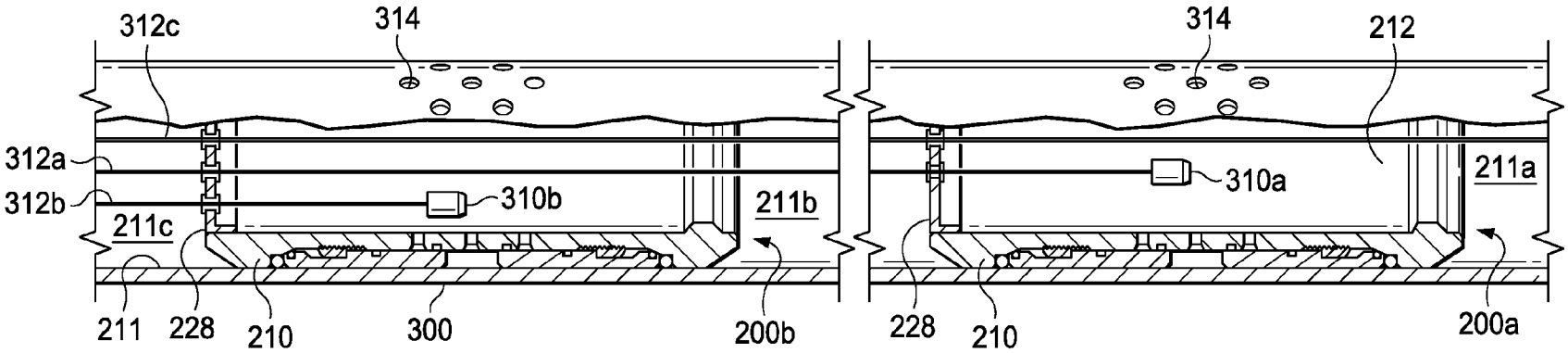
FIG. 4C is a cut-away view of an embodiment of a wellbore monitoring system during a third stage of assembly.

In the embodiment illustrated by FIGS. 1 and 4C, the first sensor 310*a* is disposed within the first coiled tubing region

211*a* and the second sensor 310*b* is disposed within the second coiled tubing region 211*b*. Also, in the embodiments of FIGS. 1 and 4C, each of the various regions of the coiled tubing (e.g., the first coiled tubing region 211*a*, the second coiled tubing region 211*b*, and the third coiled tubing region 211*c*) are fluidicly isolated from any other region thereof (e.g., by the deployed CTPAs).

In an embodiment, a wellbore monitoring method utilizing a wellbore monitoring system (such as the wellbore monitoring system 350 disclosed herein) comprising coiled tubing having one or more CTPAs (such as the first CTPA 200*a* and the second CTPA 200*b* disclosed herein) is also disclosed herein. Such a method may comprise providing a wellbore monitoring system (e.g., wellbore monitoring system 350) comprising coiled tubing having one or more CTPAs (e.g., CTPA 200), disposing the wellbore monitoring system 350 within a wellbore 114 and/or casing string 120, and logging data from the one or more sensors 310 of the wellbore monitoring system 350.

In an embodiment, providing a wellbore monitoring system may generally comprise the steps of providing a length of coiled tubing 300, disposing data conduits 312 within the coiled tubing 300, affixing at least two sensors 310 to the two or more data conduits 312, securing at least two CTPAs 200 within the coiled tubing 300, and establishing a route of fluid communication from the exterior of the coil tubing 300 to two or more sensor 310. Referring to FIGS. 4A, 4B, and 4C, a portion of a wellbore servicing system 350 is shown at various, sequential stages of an assembly process, as will be disclosed herein.

In an embodiment, a length of coiled tubing 300 may be unspooled and/or extended, for example, by uncoiling the length of coiled tubing 300 onto a suitable surface (e.g., an airplane runway, a street, a field, an assembly belt, etc.). In an embodiment, the length of coiled tubing 300 may be measured and/or cut to a desired length, for example, a length associated with a desired monitoring location within a wellbore.

In an embodiment, a plurality of sensor ports 314 may be formed through the walls of the coiled tubing 300, for example, using a drilling jig disposed onto or about the exterior of the coiled tubing 300 in two or more locations. In an embodiment the plurality of sensor ports 314 may be provided (e.g., drilled) prior to disposing the data conduits 312, sensors 310, and/or CTPAs within the coiled tubing. Alternatively, the plurality of sensor ports 314 may be provided (e.g., drilled) after the data conduits 312, sensors 310, and/or CTPAs have been disposed within the coiled tubing, as will be disclosed herein.

In an embodiment, the two or more data conduits 312 may be passed through the axial flowbore 211 of the length of coiled tubing 300, for example, from a heel 300*b* end (e.g., an upper end, when disposed within the wellbore 114) toward a toe 300*a* end (e.g., a lower end, when disposed within the wellbore 114) of the coiled tubing 300 by any suitable method, as illustrated in FIG. 4A; alternatively, from the toe 300*a* end to the heel 300*b* end of the coiled tubing 300. For example, in an embodiment, the two or more data conduits 312 may be blown through the axial flowbore 211 of the coiled tubing 300 using compressed air (e.g., such that the movement of air through the coiled tubing carries the data conduits 312 through the data conduits into and/or through the coiled tubing). In an alternative embodiment, the two or more data conduits 312 may be pulled through the axial flowbore 211 of the coiled tubing 300 using a winch cable, a tractor, and/or any other suitable pulling devices, as may be appreciated by one of skill in the art upon viewing this disclosure. Additionally, in an embodiment, the two or more data conduits 312 may be disposed such that the wire ends may be at least partially and/or substantially exposed outside of (e.g., beyond) the toe 300*a* and/or heel 300*b* of the coiled tubing 300, for example, as shown in FIG. 4A.

In an embodiment, two or more CTPAs 200 (e.g., a first CTPA 200*a* and a second CTPA 200*b*) may be disposed over, and/or onto one or more data conduits 312, for example, the data conduits extending from the toe end 300*a* of the coiled tubing 300. For example, in an embodiment where the CTPAs comprise a fluid barrier 228, the data conduits 312 may be disposed through the fluid barrier 228 and, in addition, fully or partially through the axial flowbore 212 of the CTPA. Particularly, in the embodiment illustrated in FIGS. 4A, 4B, and 4C, the first, second, and third data conduits (312*a*, 312*b*, and 312*c*, respectively) may be disposed through the second CTPA 200*b* (e.g., the upper-most CTPA) and the first and third data conduits (312*a* and 312*c*, respectively) may be disposed through the first CTPA 200*a* (e.g., the lower-most CTPA). Additionally, in such an embodiment, one or more of the data conduits 312 may be secured within the fluid barrier (e.g., within a bore extending through the plate 228*a* of the fluid barrier) with a grommet-system 228*b*, thereby forming a fluid-tight or substantially fluid tight-seal preventing fluid flow through the axial flowbore 212 of the housing 210 of the CTPA 200.

In an embodiment, the two or more sensors 310 may be attached to the two or more data conduits 312, for example, after the data conduits 312 have been disposed through the CTPAs 200. For example, in the embodiment of FIGS. 4A-4C, the first sensor 310*a* may be attached (e.g., via a hardwired electrical connection) to a first wire 312*a* (e.g., a copper wire) and a second sensor 310*b* may be attached (e.g., via a hardwired electrical connection) to a second wire 312*b*. In an embodiment, the two or more sensors 310 may be attached to the two or more wires 312 using mating connections, for example, using mating terminal connectors. In an additional or alternative embodiment, the two or more sensors 310 may be attached to the two or more wires 312 by any suitable methods as would be appreciated by one of skill in the art upon viewing this disclosure. Additionally, in the embodiment of FIGS. 4A-4C, the third data conduit 312*c* may comprise a fiber optic cable.

In an embodiment, for example, following attachment of the sensors 310 to the data conduits 312, the two or more data conduits 312, the two or more CTPAs 200, and/or two or more sensors 310 may be retracted (pulled) within the axial flowbore 211 (e.g., in a direction from the toe 300*a* towards the heel 300*b*) of the coiled tubing 300 and/or may be positioned within the axial flowbore 211 of the coiled tubing 300, for example, such that the first sensor 310*a*, the first CTPA 200*a*, the second sensor 310*b*, and or the second CTPA 200*b* is positioned at a desired location within the coiled tubing (e.g., a given distance from the heel end 300*b* and/or toe end 300*a* of the coiled tubing). For example, in an embodiment, a pulling tool (e.g., a cable wench) may attach to the ends of the data conduits 312 and may be utilized to pull the data conduits 312, CTPAs 200, and sensors 310 into and through the axial flowbore 211 of the coiled tubing 300. In an embodiment, the CTPAs 200 and sensors 310 may be pulled into and through the axial flowbore 211 via the data conduits 312, alternatively, via a cable or rope (e.g., an aircraft cable) which may have been introduced through the coiled tubing 300 along with the data conduits 312. In an embodiment, for example, in the embodiment of FIG. 4B, the first sensor 310*a* and the second sensor 310*b* may be disposed/positioned within or proximate to the axial bore 212 of the housing 210 of the first CTPA 200*a* and the second CTPA 200*b*, respectively. Alternatively, in an embodiment, the first sensor 310*a* may be positioned in fluid communication with the axial flowbore 211 of the coiled tubing 300 relatively downward from the first CTPA 200*a* and the second sensor 310*b* may be positioned within the axial flowbore 211 of the coiled tubing 300 between the first CTPA 200*a* and the second CTPA 200*b*. Additionally, in an embodiment where sensor ports 314 are already present within the coiled tubing 300, the CTPAs and sensors may be positioned such that the first sensor 310*a* and the second sensor 310*b* are each in fluid communication with at least a portion of such sensor ports 314. For example, in an embodiment the first CTPA 200*a* may be positioned above (e.g., uphole from) a first group or cluster of sensor ports 314 and below (e.g., downhole from) a second cluster of sensor ports 314, and the second CTPA 200*b* may be positioned above the second cluster of sensor ports 314.

In an embodiment, one or more temporary terminal caps may be disposed onto coiled tubing 300 after the CTPAs 200 and sensors have been positioned therein. For example, such a temporary terminal cap may be disposed onto the toe 300*a* end of the coiled tubing 300, and may seal the coiled tubing 300. In an additional or alternative embodiment, a temporary terminal cap may also be disposed onto the heel 300*a* of the coiled tubing 300. In an embodiment, the temporary terminal cap may be attached by any suitable methods as would be appreciated by one of skill in the art upon viewing this disclosure, for example, using internally and/or externally threaded surfaces.

In an embodiment, when the CTPAs (e.g., the first and second CTPA, 200*a* and 200*b*) and sensors 310 (e.g., the first and second sensors 310*a* and 310*b*) have been positioned within the axial flowbore of the coiled tubing 300, for example, at a desired location therein, the CTPAs may be secured within the coiled tubing 300. In an embodiment, securing the CTPAs 200 within the coiled tubing 300 may comprise applying a fluid pressure (e.g., air pressure) to the axial flowbore 211 of the coiled tubing 300 and/or the axial flowbore 212 of one or more of the CTPAs 200, for example, such that the pressure reaches an upper threshold. In an embodiment, the application of such an air pressure may be effective to transition the first sliding sleeve 220*a* and the second sliding sleeve 220*b* of the first CTPA 200*a* and/or the second CTPA 200*b* from the first position to the second position. As disclosed herein, the application of an air pressure to the first CTPA 200*a* and/or the second CTPA 200*b* may yield a force in the direction of the second position, for example, because of a differential between the force applied to the first sliding sleeve 220*a* and the second sliding sleeve 220*b* in the direction towards the second position (e.g., an outward force) and the force applied to the first sliding sleeve 200*a* and the second sliding sleeve 220*b* in the direction away from the second position (e.g., an inward force).

In an embodiment, the fluid pressure (e.g., air pressure) threshold may be of a magnitude sufficient to exert a force in the direction of the second position sufficient to reposition the first sliding sleeve 220*a* and the second sliding sleeve 200*b* relative to the housing 210 in the direction of the second position, thereby transitioning the first sliding sleeve 220*a* and the second sliding sleeve 220*b* from the first position to the second position. In an embodiment, transitioning each of the first sliding sleeve 220*a* and the second sliding sleeve 220*b* to the second position may cause the first and second sliding sleeves, 220*a* and 220*b*, to compress the sealing elements 250, for example, thereby causing the sealing elements to expand radially 250. For example, in an embodiment, the sealing element 250 may become forcibly engaged with the coiled tubing 300, for example, due to compression by the second contact surface 220*d* of the first sliding sleeve 220*a* and/or the second sliding sleeve 220*b* and the fixed contact surface 210*b* of the housing 210, thereby securing one or more CTPAs 200 to the coiled tubing 300.

In an embodiment, the air pressure threshold level may be at least about 250 p.s.i, alternatively, at least 500 p.s.i, alternatively, at least 750 p.s.i, alternatively, at least 1,000 p.s.i, alternatively, at least 1,250 p.s.i, alternatively, at least 1,500 p.s.i, alternatively, at least 1,750 p.s.i, alternatively, at least 2,000 p.s.i, alternatively, at least 3,000 p.s.i, alternatively, at least 4,000 p.s.i, alternatively, at least 6,000 p.s.i, alternatively, any suitable pressure that may be obtained not exceeding the maximal pressure ratings of the CTPA 200 and/or the coiled tubing 300.

In an embodiment, the air pressure may be applied to the via coiled tubing 300 via one or both exposed ends (e.g., any end not sealed by a terminating cap) of the coiled tubing 300. For example, where the coiled tubing 300 comprises a temporary terminal cap disposed on the toe end 300*a* of the coiled tubing 300, the air pressure may be applied to the axial flowbore 211 from the heel end 300*b* of the coiled tubing 300. Alternatively, where the coiled tubing 300 comprises a temporary terminal cap disposed on the heel end 300*b* of the coiled tubing 300, the air pressure may be applied to the axial flowbore 211 from the toe end 300*a* of the coiled tubing 300. In an additional or alternative embodiment, the coiled tubing 300 not comprise temporary terminal caps on either end and an air pressure may be applied to either or both ends (e.g., the toe end 300*a* and/or the heel end 300*b*) of the coiled tubing, for example, via ports or nipples allowing connection of a high-pressure air source. In another additional or alternative embodiment, where sensor ports are previously disposed within the coiled tubing 300, the coiled tubing may comprise temporary terminal cap on both ends (e.g., the toe end 300*a* and the heel end 300*b*), on one end, or on neither end, and an air pressure may be applied (solely or in conjunction with pressure applied via one or both ends) via the plurality of sensor ports 314. Alternatively, sensor ports 314 may be temporarily sealed as needed to pressure up the axial flowbore 211.

In an embodiment, a pressure of at least an upper threshold may be applied within the axial flowbore 211 of the coiled tubing 300 and/or the axial flowbore 212 of the two or more CTPAs 200, thereby transitioning the two or more CTPAs 200 to the second position concurrently, for example, about simultaneously transitioning the sliding sleeves of both the first CTPA 200*a* and the second CTPA 200*b* from the first position to the second position.

In an alternative embodiment, applying the air pressure of at least an upper threshold within the axial flowbore 211 of the coiled tubing 300 and/or the axial flowbore 212 of the CTPAs 200 may cause the sliding sleeves of the first CTPA 200*a* and the second CTPA 200*b* to transition to the second position sequentially. For example, in an embodiment, the sliding sleeves of the first CTPA 200*a* may be configured to transition to the second position upon experiencing a pressure threshold that is lower than the pressure threshold at which the sliding sleeves of the second CTPA 200*b* may be configured to transition to the second position. Alternatively, in an embodiment, the sliding sleeves of the second CTPA 200*b* may be configured to transition to the second position upon experiencing a pressure threshold that is lower than the pressure threshold at which the sliding sleeves of the first CTPA 200*a* may be configured to transition to the second position. For example, in an embodiment, one or more of the CTPAs 200 (e.g., the first CTPA 200*a* and/or the second CTPA 200*b*) may further comprise one or more shear pins. In such an embodiment, the one or more shear pins may retain the first sliding sleeve 220*a* and/or the second sliding sleeve 220*b* in the first position and may shear upon application of air pressure of at least a desired threshold to the CTPA 200, thereby allowing the first sliding sleeve 220*a* and/or the second sliding sleeve 220*b* to transition to the second position. In such an embodiment, the one or more shear pins of each CTPA 200 may be sized to require more or less air pressure. In such an embodiment, the shear pins associated with the first CTPA 200*a* may be configured to shear at a pressure threshold that is greater than, alternatively, less than, the pressure threshold at which the shear pins associated with the second CTPA 200*b* may be configured to shear. For example, in an embodiment, upon application of an air pressure to the flow bore 211 of the coiled tubing 300 the shear pins of CTPA 200 located at the toe end 300*a* (e.g., the first CTPA 200*a*) of the coiled tubing 300 may shear first and, as the pressure builds within flow bore 211 of the coiled tubing 300, the shear pins of the CTPA 200 located at the heel end 300*b* (e.g., the second CTPA 200*b*) may shear second, alternatively, vice versa.

Additionally or alternatively, in an embodiment, one or more of the CTPAs 200 (e.g., the first CTPA 200*a*, the second CTPA 200*b*, or both) may each further comprise a destructible member (e.g., a rupture plate or disc) over the ports 206 of the CTPA 200. In such an embodiment, the destructible member may prevent a route of communication from the axial flow bore 212 of the housing 210 to the first sliding sleeve 220*a* and/or the second sliding sleeve 220*b*, thereby preventing the application of pressure force to transition the first sliding sleeve 220*a* and/or the second sliding sleeve 220*b* to the second position. Additionally, in such an embodiment, the destructible member may be configured to rupture upon experiencing at least a pressure threshold corresponding to the CTPA 200. In such an embodiment, the destructible member of each CTPA 200 may be sized and/or configured to require more or less air pressure to rupture dependent upon the desired order or sequence of actuation of the first CTPA 200*a* and the second CTPA 200*b* (e.g., relative to position of a given CTPA within the coiled tubing 300), similar to previously disclosed.

In an embodiment, the first sliding sleeve 220*a* and the second sliding sleeve 220*b* may be retained in the second position and/or prohibited from returning to the first position by the locking system 204 (e.g., interlocked ratcheting teeth). For example, in such an embodiment, upon reaching the second position, the locking system 204 may retain the first and second sliding sleeves, 220*a* and 220*b*, such that the sealing elements 250 remain radially expanded and, thereby, the CTPAs 200 remain engaged within the coiled tubing 300.

In an embodiment, following securing the two or more CTPAs 200 within the coiled tubing 300 (e.g., by transitioning the sliding sleeves, 220*a* and 220*b*, thereof from the first position to the second position) the temporary terminal cap may be replaced with a permanent terminal cap 320 (e.g., a bullet nose bull plug). Additionally or alternatively, in an embodiment, the permanent cap or the temporary terminal cap may be joined to the coiled tubing 300, for example, a chemical reaction such as a glue or bonding material, a welded bond, a threaded connection, or any other suitable methods as would be appreciated by one of skill in the arts upon viewing this disclosure.

In an embodiment, one or more sensor ports 314 may be unsealed and/or introduced into the coiled tubing 300. For example, in an embodiment, one or more holes may be drilled into the coiled tubing 300, thereby creating the one or more sensor ports 314. In an embodiment, the sensor ports 314 may provide a route of communication from the exterior of the coiled tubing 300 to the axial flowbore 211 of the coiled tubing 300 and/or the axial flowbore 212 of the two or more CTPAs 200. For example, in an embodiment, the drill may also penetrate the housing 210 of the CTPA 200, thereby creating one or more sensor ports 207 and, thereby, providing a route of fluid communication from the axial flowbore 212 of the CTPA 200 to the exterior of the coiled tubing 300. In such an embodiment, the one or more sensor ports 314 may be in fluid communication with the one or more sensor ports 207 and/or the axial flowbore 212 of the CTPA 200 and may provide a route of fluid communication from within the axial flowbore 212 of the CTPA 200 to the exterior of the coiled tubing 300, and vice-versa.

As disclosed herein, in an embodiment, following establishing of a route of fluid communication via the sensor ports 314 and/or the sensor ports 207, the two or more sensors 310 may be in fluid communication with the exterior of the coiled tubing 300 and surrounding ambient wellbore conditions via the one or more sensor ports 207 and/or sensor ports 314. In such an embodiment, the sensor ports 314 extending through the coiled tubing 300 and/or the sensor ports 207 extending through the housing 210 of the CTPAs 200 may allows for the sensors to experience one or more ambient wellbore conditions (e.g., a temperature, a pressure, or another relevant condition within the wellbore) upon placement within the wellbore, as will be disclosed herein.

In an embodiment, following assembly of the wellbore monitoring system 350, the assembled wellbore monitoring system 350 may be respooled or rewound, for example, for transport to a wellsite.

In an embodiment, for example as illustrated in FIG. 1, the wellbore monitoring system 350 may be introduced within a wellbore 114 and/or a casing string 120. In an embodiment, the wellbore monitoring system 350 may be at least partially and/or substantially exposed to hydrocarbons (e.g., oil, gas) and/or other wellbore fluids within the axial flowbore 103 of the wellbore 114. In such an embodiment, the two or more sensors 310 may be exposed to the wellbore fluids within the axial flowbore 103 of the wellbore 114. In an embodiment, the wellbore monitoring system may be run into the wellbore 114 via a coiled tubing unit or other suitable machinery located at the wellsite, as will be appreciated by one of skill in the art upon viewing this disclosure.

In an embodiment, at least a portion of the wellbore monitoring system 350 and/or the two or more data conduits 312 of the wellbore monitoring system 350 may be accessible above the earth's surface 104. For example, in an embodiment, the wellbore monitoring system 350 and/or the two or more data conduits 312 may be accessible from the earth's surface 104 via a casing string cover 360.

In an embodiment, wellbore data (e.g., pressure data, temperature data) may be collected from the wellbore monitoring system 350 via the two or more data conduits 312. For example, in an embodiment, the two or more data conduits 312 may be attached at the surface to monitoring and/or recording equipment (e.g., a computer, a data acquisition (DAQ) unit, etc.). In such an embodiment, the wellbore data from the two or more sensors 310 may be sampled for some duration of time (e.g., seconds, minutes, hours, days, weeks, months, years, etc.). Additionally or alternatively, the wellbore data from the two or more sensors 310 may be sampled at or about real time. Additionally or alternatively, the wellbore data may be transmitted (e.g., via a radio signal or other communication unit located at the wellsite) to a remote location, for example, for analysis. In an embodiment, a plurality of wellbores equipped with wellbore monitoring systems 350 are part of a distributed supervisory control and data acquisition (SCADA) monitoring system. In an embodiment, data collected (e.g., via the wellbore monitoring system) may be utilized to evaluate, model, and/or predict wellbore performance, determine the necessity of any wellbore servicing procedures, or combinations thereof.

In an embodiment, a wellbore monitoring system and method comprising coiled tubing having one or more CTPA 200, as disclosed herein or in some portion thereof, may be an advantageous means by which to monitor a wellbore, for example, for wellbore data (e.g., pressure data, temperature data) collections. For example, in an embodiment, a wellbore monitoring method comprising two or more CTPAs 200 enables assembling a wellbore monitoring system 350 without the need for segmenting and/or cutting and reattaching portions of the coiled tubing 300 as is performed in conventional methods. Additionally, in an embodiment, such a method may not require the usage of coiled tubing inserts and/or windows such as those used in conventional methods.

In conventional methods, the two most common types of coiled tubing monitoring applications are wet coil and dry coil. In a wet coil application, the wellbore fluids are exposed to the sensors and wiring. Over time the wellbore fluids can penetrate the wiring and cause the system to fail (e.g., electrical shorts). As a result, the preferred approach is the dry coil application wherein the sensors and/or wires are isolated and protected within the coiled tubing. Additionally, in an embodiment, such a wellbore monitoring method, as previously disclosed, may allow the wellbore monitoring system to be used in dry and/or semi-dry applications depending on the configuration of the wellbore monitoring system 350 and the two or more sensors 310. Conventional methods may not be capable of restricting and/or controlling the route of fluid communication to one or more sensors and therefore may be unable to provide a configurable system for use in dry and/or semi-dry applications.

ADDITIONAL DISCLOSURE

The following are nonlimiting, specific embodiments in accordance with the present disclosure:

A first embodiment, which is a wellbore monitoring system comprising:

- a length of tubing defining an axial flowbore;
- two or more data conduits extending within the axial flowbore of the coiled tubing;
- two or more sensors, each of the two or more sensors configured to measure a wellbore parameter and to communicate data indicative of the measured wellbore parameter via one of the two or more data conduits; and
- two or more deployable tubular packers, each of the deployable tubular packers disposed within the axial flowbore of the tubing;
  - wherein each of the deployable tubular packers is selectively secured within the axial flowbore of the tubing; and
  - wherein the two deployable tubular packers provide fluid isolation between a first region of the axial flowbore, a second region of the axial flowbore, and a third region of the axial flowbore.

A second embodiment, which is the wellbore monitoring system of the first embodiment, wherein the tubing comprises coiled tubing.

A third embodiment, which is the wellbore monitoring system of one of the first through the second embodiments, wherein the two or more data conduits comprise a first copper wire, a second copper wire, or a fiber optic cable.

A fourth embodiment, which is the wellbore monitoring system of one of the first through the third embodiments, wherein each of the two or more sensors comprises a temperature sensor, a pressure sensor, or combinations thereof.

A fifth embodiment, which is the wellbore monitoring system of one of the first through the fourth embodiments, wherein each of the two or more deployable tubular packers comprises a fluid barrier, the fluid barrier comprising an orifice, at least one of the two or more data conduits being disposed within the orifice.

A sixth embodiment, which is the wellbore monitoring system of the fifth embodiment, wherein the at least one of the two or more data conduits is secured within the orifice by a grommet, wherein the grommet is configured to prevent fluid communication through the orifice.

A seventh embodiment, which is the wellbore servicing system of one of the first through the sixth embodiments, wherein each of the two or more deployable tubular packers is secured within the coiled tubing responsive to an application of pressure of at least a first threshold to the axial flowbore.

An eighth embodiment, which is the wellbore servicing system of one of the first through the seventh embodiments, wherein each of the two or more deployable tubular packers comprises:

- a mandrel;
- a sealing element, the sealing element being circumferentially disposed around the mandrel; and
- a sliding sleeve, the sliding sleeve being slidably and circumferentially disposed around the mandrel and movable from a first position relative to the mandrel to a second position relative to the mandrel,
- wherein, in the first position, the sliding sleeve does not compress the sealing element so as to cause the sealing element to expand radially, and
- wherein, in the second position, the sliding sleeve compresses the sealing element so as to cause the sealing element to expand radially.

A ninth embodiment, which is the wellbore monitoring system of one of the first through the eighth embodiments, wherein the tubing comprises a port providing a route of fluid communication from an exterior of the tubing at least one of the two or more sensors.

A tenth embodiment, which is the wellbore monitoring system of one of the first through the ninth embodiments, wherein the tubing comprises a terminal cap.

An eleventh embodiment, which is a wellbore monitoring method comprising:

- assembling a wellbore monitoring system, wherein assembling the wellbore monitoring system comprises:
  - providing a length of tubing, wherein the tubing defines an axial flowbore;
  - disposing two or more data conduits within the tubing;
  - affixing a sensor to at least one of the two or more data conduits;
  - securing two or more deployable tubular packers within the tubing, wherein securing the two or more deployable tubular packers within the tubing is effective to provide fluid isolation between a first region of the axial flowbore, a second region of the axial flowbore, and a third region of the axial flowbore; and
  - establishing a port within the tubing, wherein the port provides a route of fluid communication from an exterior of the tubing to at least one of the two or more sensors.

A twelfth embodiment, which is the method of the eleventh embodiment, wherein the tubing comprises coiled tubing, and wherein providing the length of tubing comprises uncoiling the coiled tubing.

A thirteenth embodiment, which is the method of one of the eleventh through the twelfth embodiments, wherein disposing two or more data conduits within the tubing comprises blowing the data conduits through the tubing.

A fourteenth embodiment, which is the method of one of the eleventh through the thirteenth embodiments, wherein assembling the wellbore monitoring system further comprises:

prior to securing the two or more deployable tubular packers within the tubing, disposing at least one of the two or more data conduits through at least one of the deployable tubular packers; and positioning each of the two or more deployable tubular packers within the tubular.

A fifteenth embodiment, which is the method of one of the eleventh through the fourteenth embodiments, wherein securing the two or more deployable tubular packers within the tubing comprises applying a pressure of at least a first threshold to the axial flowbore of the tubing.

A sixteenth embodiment, which is the method of the fifteenth embodiment, wherein, upon the application of pressure, the deployable tubular packers are secured within the tubing substantially simultaneously.

A seventeenth embodiment, which is the method of the fifteenth embodiment, wherein, upon the application of pressure, a first of the two or more deployable tubular packers becomes secured within the tubing substantially before a second of the two or more deployable tubular packers becomes secured within the tubing.

An eighteenth embodiment, which is the method of one of the eleventh through the seventeenth embodiments, wherein the establishing the port comprises drilling one or more holes within the tubing.

A nineteenth embodiment, which is the method of one of the eleventh through the eighteenth embodiments, further comprising:

transporting the wellbore monitoring system to a wellbore; and disposing the wellbore monitoring system within the wellbore.

A twentieth embodiment, which is the method of the nineteenth embodiment, wherein transporting the wellbore monitoring system to the wellbore comprises recoiling the tubing after assembling the wellbore monitoring system.

A twenty-first embodiment, which is a wellbore monitoring method comprising:

providing a wellbore monitoring system comprising:

a length of tubing defining an axial flowbore;

two or more sensors; and two or more deployable tubular packers, each of the deployable tubing packers disposed within the axial flowbore of the tubing so as to provide fluid isolation between a first region of the axial flowbore, a second region of the axial flowbore, and a third region of the axial flowbore, wherein a first sensor of the two or more sensors is located in the first region and a second sensor of the two or more sensors is located in a second region and a third region is a dry-coil region;

disposing the wellbore monitoring system within a wellbore; and logging data from the two or more sensors.

A twenty-second embodiment, which is the wellbore monitoring method of the twenty-first embodiment, wherein providing a wellbore monitoring comprises:

providing the length of tubing;

disposing two or more data conduits within the tubing;

affixing one of the two or more sensors to at least one of the two or more data conduits; and securing the two or more deployable tubular packers within the tubing to define or establish the first, the second, and the third regions.

A twenty-third embodiment, which is the wellbore monitoring method of one of the twenty-first through the twenty-second embodiments, wherein the data comprises pressure data, temperature data, or combinations thereof.

A twenty-fourth embodiment, which is the wellbore monitoring method of one of the twenty-first through the twenty-third embodiments, further comprising transmitting the data to a remote location, storing the data, or combinations thereof.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, R1, and an upper limit, Ru, is disclosed, any number falling within the range is specifically disclosed. In particular, the following numbers within the range are specifically disclosed: $R=R1+k*(Ru-R1)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Detailed Description of the Embodiments is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A wellbore monitoring system comprising:

a coiled tubing defining an axial flowbore and selectively positionable within a wellbore;

two or more data conduits extending within the axial flowbore;

two or more sensors, each of the two or more sensors configured to measure a wellbore parameter and to communicate data indicative of the measured wellbore parameter via one of the two or more data conduits; and two or more tubular packers disposed within the axial flowbore, each of the tubular packers having a radially expandable sealing element and a locking system, each of the tubular packers operable in a deployable first state in which the sealing element is contracted and the tubular packer is movable within the axial flowbore, each of the tubular packers further operable in a locked second state in which the sealing element is radially expanded into sealing engagement with an interior wall surface of the axial flowbore, the tubular packer is fixed within the axial flowbore, and the locking system mechanically prevents contraction of the sealing element;

wherein the two tubular packers provide fluid isolation between a first region of the axial flowbore, a second region of the axial flowbore, and a third region of the axial flowbore.

2. The wellbore monitoring system of claim 1, wherein the coiled tubing is disposed within the wellbore.

3. The wellbore monitoring system of claim 1, wherein the two or more data conduits comprise a first copper wire, a second copper wire, or a fiber optic cable.

4. The wellbore monitoring system of claim 1, wherein each of the two or more sensors comprises a temperature sensor, a pressure sensor, or combinations thereof.

5. The wellbore monitoring system of claim 1, wherein each of the two or more tubular packers comprises a fluid barrier, the fluid barrier comprising an orifice, at least one of the two or more data conduits being disposed within the orifice.

6. The wellbore monitoring system of claim 5, wherein the at least one of the two or more data conduits is secured within the orifice by a grommet, wherein the grommet is configured to prevent fluid communication through the orifice.

7. The wellbore servicing system of claim 1, wherein each of the two or more tubular packers is securable within the axial flowbore responsive to an application of pressure of at least a first threshold to the axial flowbore.

8. The wellbore monitoring system of claim 1, wherein each of the two or more tubular packers comprises:

a mandrel, the sealing element being circumferentially disposed around the mandrel; and a sleeve slideably and circumferentially disposed around the mandrel and movable relative to the mandrel from a first position, wherein the sleeve does not compress the sealing element so as to cause the sealing element to expand radially, to a second position, wherein the sleeve compresses the sealing element so as to cause the sealing element to expand radially, said locking system coupled to said sleeve so as to prevent movement of said sleeve from said second position to said first position.

9. The wellbore monitoring system of claim 1, further comprising a port formed through a wall of said coiled tubing to provide a route of fluid communication from an exterior of the coiled tubing at least one of the two or more sensors.

10. The wellbore monitoring system of claim 1, further comprising a terminal cap connected to an end of the length of coiled tubing.

11. A wellbore monitoring method comprising:

providing a coiled tubing, the coiled tubing defining an axial flowbore;

disposing two or more data conduits within the axial flowbore;

affixing a first sensor to at least one of the two or more data conduits;

establishing a port through a wall the coiled tubing, wherein the port provides a route of fluid communication from an exterior of the coiled tubing to the sensor;

positioning two or more tubular packers within the coiled tubing; then radially expanding a sealing element of each said tubular packer into sealing engagement with an interior wall surface of said coiled tubing; and mechanically locking said sealing element of each said tubular packer into said sealing engagement.

12. The method of claim 11, further comprising:

uncoiling the coiled tubing; then disposing the data conduits within the axial flowbore.

13. The method of claim 12 further comprising recoiling the coiled tubing after disposing the data conduits within the axial flowbore.

14. The method of claim 11, wherein disposing the data conduits within the axial flowbore includes blowing the data conduits through the coiled tubing.

15. The method of claim 11, further comprising:

prior to positioning the tubular packers, disposing at least one of the two or more data conduits through at least one of the tubular packers.

16. The method of claim 11, further comprising applying a pressure of at least a first threshold to the axial flowbore to radially expand the sealing element of at least one of the tubular packers.

17. The method of claim 16, wherein, upon the application of pressure, the sealing elements of the two or more tubular packers are radially expanded substantially simultaneously.

18. The method of claim 16, wherein, upon the application of pressure, a first of the two or more tubular packers becomes secured within the coiled tubing substantially before a second of the two or more tubular packers becomes secured within the coiled tubing.

19. The method of claim 11 further comprising:

providing by said at least two tubular packers fluid isolation between a first region of the axial flowbore, a second region of the axial flowbore, and a third region of the axial flowbore, wherein the third region is a dry-coil region;

locating the first sensor in the first region;

locating a second sensor in the second region;

disposing the wellbore monitoring system within a wellbore; and logging data from the first and second sensors.

20. The method of claim 19, wherein the data includes at least one of pressure data and temperature data.

21. The method of claim 19, further comprising at least one of transmitting the data to a remote location and storing the data.

* * * * *